US009358472B2

(12) United States Patent
Hunter et al.

(10) Patent No.: US 9,358,472 B2
(45) Date of Patent: Jun. 7, 2016

(54) MOTION CONTROL SYSTEM AND METHOD FOR AN AMUSEMENT RIDE

(75) Inventors: Richard D. Hunter, Ottawa (CA); Raymond T. Smegal, Nepean (CA)

(73) Assignee: HM Attractions, Inc., Ottawa, Ontario (CA)

( * ) Notice: Subject to any disclaimer, the term of this patent is extended or adjusted under 35 U.S.C. 154(b) by 45 days.

(21) Appl. No.: 14/128,363

(22) PCT Filed: Jun. 29, 2012

(86) PCT No.: PCT/CA2012/050443

§ 371 (c)(1), (2), (4) Date: Apr. 7, 2014

(87) PCT Pub. No.: WO2013/000090

PCT Pub. Date: Jan. 3, 2013

(65) Prior Publication Data

US 2014/0216297 A1 Aug. 7, 2014

Related U.S. Application Data

(60) Provisional application No. 61/503,185, filed on Jun. 30, 2011.

(51) Int. Cl.
*A63G 21/18* (2006.01)
*A63G 31/00* (2006.01)
(Continued)

(52) U.S. Cl.
CPC ..... *A63G 21/18* (2013.01); *A63G 21/02* (2013.01); *A63G 21/12* (2013.01); *A63G 31/007* (2013.01)

(58) Field of Classification Search
CPC ..... A63G 21/02; A63G 21/14; A63G 21/12; A63G 21/18; A63G 3/02; A63G 43/08; A63G 17/26; A63G 37/00; A63G 31/10; A63G 31/007
USPC ..... 104/53, 56, 59, 63, 64, 69, 70, 72, 73, 104/290, 292
See application file for complete search history.

(56) References Cited

U.S. PATENT DOCUMENTS 3,404,635 A 10/1968 Bacon et al.
3,577,928 A * 5/1971 Victorri ..... 104/292
(Continued)

FOREIGN PATENT DOCUMENTS

CA 2473804 8/2003
CN 2303755 Y 1/1999
(Continued)

OTHER PUBLICATIONS

PCT International Search Report and Written Opinion completed by the ISA/CA on Sep. 11, 2012 and issued in connection with PCT/CA2012/050443.
(Continued)

*Primary Examiner* — Jason C Smith
(74) *Attorney, Agent, or Firm* — Barnes & Thornburg LLP

(57) ABSTRACT

A amusement ride feature comprises a waterslide sliding surface, a vehicle having a vehicle bottom surface adapted to slide on said sliding surface and to convey at least one rider thereon, and at least one reaction plate and at least one permanent magnet each mounted to one of said vehicle and said sliding surface. The at least one reaction plate and the at least one permanent magnet are positioned to affect motion of the vehicle when the motion of the vehicle brings the reaction plate under the influence of the permanent magnet.

14 Claims, 7 Drawing Sheets

(51) Int. Cl.
*A63G 21/02* (2006.01)
*A63G 21/12* (2006.01)

(56) References Cited

U.S. PATENT DOCUMENTS

| | | | | |
|---|---|---|---|---|
| 3,585,939 | A | 6/1971 | Laithwaite et al. | |
| 3,667,397 | A * | 6/1972 | Haynes | 104/294 |
| 3,667,398 | A * | 6/1972 | English | 104/294 |
| 3,680,488 | A * | 8/1972 | Donlon | 104/130.07 |
| 3,696,753 | A * | 10/1972 | Ross et al. | 104/123 |
| 3,712,240 | A | 1/1973 | Donion et al. | |
| 3,738,281 | A * | 6/1973 | Waidelich | 104/23.2 |
| 3,770,995 | A * | 11/1973 | Eastham et al. | 104/294 |
| 3,830,161 | A * | 8/1974 | Bacon | 104/70 |
| 3,882,790 | A * | 5/1975 | Winkle et al. | 104/286 |
| 3,889,605 | A | 6/1975 | Bacon | |
| 3,947,741 | A | 3/1976 | Ball et al. | |
| 3,952,666 | A * | 4/1976 | Gladish | 104/23.2 |
| 4,061,089 | A * | 12/1977 | Sawyer | 104/23.2 |
| 4,063,517 | A * | 12/1977 | Nardozzi, Jr. | 104/35 |
| 4,175,637 | A * | 11/1979 | Bertelsen | 180/128 |
| 4,233,906 | A | 11/1980 | Seiler | |
| 4,274,020 | A | 6/1981 | Parsch et al. | |
| 4,299,171 | A * | 11/1981 | Larson | 104/70 |
| 4,310,966 | A | 1/1982 | Breitenbach | |
| 4,484,739 | A * | 11/1984 | Kreinbihl et al. | 472/88 |
| 4,984,783 | A * | 1/1991 | Fujimaki | 472/88 |
| 4,991,514 | A * | 2/1991 | Powell et al. | 104/60 |
| 5,069,443 | A * | 12/1991 | Shiratori | 472/88 |
| 5,128,569 | A | 7/1992 | Gladish | |
| 5,277,125 | A | 1/1994 | DiFonso et al. | |
| 5,336,132 | A | 8/1994 | Murakami | |
| 5,382,026 | A | 1/1995 | Harvard et al. | |
| 5,403,238 | A * | 4/1995 | Baxter et al. | 472/43 |
| 5,433,671 | A * | 7/1995 | Davis | 472/117 |
| 5,540,622 | A * | 7/1996 | Gold et al. | 472/117 |
| 5,552,649 | A | 9/1996 | Cowan, Jr. et al. | |
| 5,628,253 | A | 5/1997 | Ozeki et al. | |
| 5,649,489 | A | 7/1997 | Powell et al. | |
| 5,668,421 | A * | 9/1997 | Gladish | 310/12.11 |
| 5,669,821 | A | 9/1997 | Prather et al. | |
| 5,860,364 | A * | 1/1999 | McKoy | 104/59 |
| 6,062,350 | A | 5/2000 | Spieldeiner et al. | |
| 6,237,499 | B1 * | 5/2001 | McKoy | 104/59 |
| 6,354,223 | B2 | 3/2002 | McKoy | |
| 6,397,755 | B1 * | 6/2002 | Kamler | 104/53 |
| 6,413,165 | B1 * | 7/2002 | Crandall et al. | 472/117 |
| 6,485,372 | B2 * | 11/2002 | Stuart et al. | 472/117 |
| 6,527,646 | B1 | 3/2003 | Briggs | |
| 6,629,501 | B2 | 10/2003 | McKoy | |
| 6,659,237 | B1 * | 12/2003 | Pribonic | 188/165 |
| 6,856,048 | B2 | 2/2005 | Funken et al. | |
| 6,857,964 | B2 | 2/2005 | Hunter | |
| 6,860,209 | B2 | 3/2005 | McKoy | |
| 6,971,317 | B2 | 12/2005 | McKoy | |
| 7,056,220 | B2 | 6/2006 | Hunter | |
| D548,810 | S * | 8/2007 | Hunter | D21/821 |
| D567,322 | S * | 4/2008 | Hunter | D21/821 |
| 7,371,183 | B2 | 5/2008 | Henry et al. | |
| 7,437,998 | B2 * | 10/2008 | Burger et al. | 104/73 |
| 7,597,630 | B2 * | 10/2009 | Henry | 472/128 |
| 7,654,203 | B2 | 2/2010 | Roop et al. | |
| 7,699,006 | B2 | 4/2010 | Miller et al. | |
| 7,699,007 | B2 * | 4/2010 | Miller et al. | 104/281 |
| 7,713,134 | B2 | 5/2010 | Hunter | |
| 7,740,542 | B2 * | 6/2010 | Henry et al. | 472/128 |
| 7,918,741 | B2 | 4/2011 | Hunter et al. | |
| 7,950,333 | B2 | 5/2011 | Crawford et al. | |
| 8,038,542 | B2 | 10/2011 | Hunter et al. | |
| 8,136,453 | B2 | 3/2012 | Hunter et al. | |
| 8,162,770 | B2 | 4/2012 | Hunter et al. | |
| 8,905,854 | B2 | 12/2014 | Hunter et al. | |
| 2002/0142851 | A1 * | 10/2002 | Hunter | 472/117 |
| 2004/0077426 | A1 * | 4/2004 | Hunter | 472/137 |
| 2004/0123766 | A1 * | 7/2004 | van den Bergh et al. | 104/281 |
| 2005/0098057 | A1 | 5/2005 | McKoy | |
| 2005/0192108 | A1 | 9/2005 | Hunter | |
| 2005/0288112 | A1 | 12/2005 | Hunter | |
| 2006/0016366 | A1 * | 1/2006 | Feix et al. | 104/286 |
| 2006/0016399 | A1 | 1/2006 | Feix et al. | |
| 2006/0032395 | A1 * | 2/2006 | Matuschek et al. | 104/286 |
| 2006/0194638 | A1 * | 8/2006 | Hunter | 472/116 |
| 2006/0219124 | A1 * | 10/2006 | Jordan | 104/23.1 |
| 2007/0034106 | A1 * | 2/2007 | Miller et al. | 104/286 |
| 2007/0060403 | A1 * | 3/2007 | Henry et al. | 472/117 |
| 2007/0204759 | A1 | 9/2007 | Hunter | |
| 2007/0207866 | A1 * | 9/2007 | Hunter | 472/43 |
| 2007/0207867 | A1 | 9/2007 | Hunter | |
| 2007/0207869 | A1 | 9/2007 | Hunter | |
| 2012/0064984 | A1 | 3/2012 | Hunter et al. | |
| 2012/0132101 | A1 | 5/2012 | Hunter et al. | |
| 2012/0173065 | A1 | 7/2012 | Hunter et al. | |
| 2014/0216297 | A1 * | 8/2014 | Hunter et al. | 104/72 |
| 2014/0357387 | A1 * | 12/2014 | Murphy | 472/117 |

FOREIGN PATENT DOCUMENTS

| | | |
|---|---|---|
| CN | 101394908 A | 3/2009 |
| DE | 2021834 | 3/1972 |
| DE | 2900053 | 7/1980 |
| DE | 4344755 | 6/1995 |
| EP | 0381136 | 8/1990 |
| EP | 0487744 | 6/1991 |
| GB | 1307833 | 2/1973 |
| JP | 50-122627 | 9/1975 |
| JP | 52-149712 | 12/1977 |
| JP | 54035914 | 3/1979 |
| JP | 3027703 | 2/1991 |
| WO | 98-31444 | 7/1998 |
| WO | 03-063991 | 8/2003 |
| WO | 2004-085744 | 10/2004 |
| WO | 2007/098601 A1 | 9/2007 |

OTHER PUBLICATIONS

Chinese Office Action for Application No. 201280032514.4, dated Jul. 27, 2015, along with English Translation.

* cited by examiner

MOTION CONTROL SYSTEM AND METHOD FOR AN AMUSEMENT RIDE

CROSS REFERENCE TO RELATED APPLICATIONS

This application is a U.S. nationalization under 35 U.S.C. §371 of International Application No. PCT/CA2012/050443, filed Jun. 29, 2012, which claims priority to U.S. Provisional Patent Application No. 61/503,185 filed Jun. 30, 2011.

FIELD OF THE INVENTION

This invention relates generally to amusement rides, and in particular to rides in which participants slide in or on vehicles.

BACKGROUND OF THE INVENTION

In the past few decades, water-based amusement rides have become increasingly popular. Such rides can provide similar thrills to roller-coaster rides, with the additional features of the cooling effect of water and the excitement of being splashed.

A common water-based amusement ride is a flume-style waterslide in which a participant slides along a channel or "flume", either on his or her body, or on or in a vehicle. Water is provided in the flume to provide lubrication between the body/vehicle and the flume surface, and to provide the above-mentioned cooling and splashing effects. Typically, the motion of the participant in the flume is controlled predominantly by the contours of the flume (hills, valleys, turns, drops, etc.) in combination with gravity.

As thrill expectations of participants have increased, demand for greater control of participants' movement in the flume or other water-based amusement ride has correspondingly increased. Thus various techniques have been applied to accelerate or decelerate participants by means other than gravity. For example, a participant may be accelerated or decelerated using powerful water jets. Other rides use a conveyor belt to convey a participant to the top of a hill the participant would not otherwise crest on the basis of his or her momentum alone. For safety reasons, such techniques are generally used only on waterslides where the participant slides along the flume in a vehicle.

However, such existing means of controlling the movement of a participant can raise safety and comfort concerns even when he or she is riding in a vehicle. For example, a water jet powerful enough to affect the motion of a waterslide vehicle could injure the participant if he or she is hit in the face or back of the head by the jet, as might be the case if the participant falls out of the vehicle. Similarly, a participant extending a limb out of a vehicle could be injured by a fast-moving conveyor belt.

SUMMARY OF THE INVENTION

Some embodiments disclosed herein relate to an amusement ride feature comprising: a sliding surface; a vehicle having a vehicle bottom surface adapted to slide on said sliding surface and to convey at least one rider thereon; and at least one reaction plate and at least one permanent magnet each mounted to one of said vehicle and said sliding surface; wherein the at least one reaction plate and the at least one permanent magnet are positioned to affect motion of the vehicle when the motion of the vehicle brings the at least one reaction plate under the influence of the at least one permanent magnet.

In some embodiments, the at least one reaction plate or the at least one permanent magnet mounted to the sliding surface is mounted to move relative to the sliding surface.

In some embodiments, the mounting comprises an endless driven member.

In some embodiments, the at least one reaction plate is mounted to the vehicle and the at least one permanent magnet is mounted to the sliding surface.

In some embodiments, the at least one reaction plate is mounted near a bottom of said vehicle and substantially parallel thereto, and said at least one reaction plate is covered by the vehicle bottom surface; and the permanent magnets are located beneath the sliding surface.

In some embodiments, the permanent magnets are mounted on a mounting assembly which is movably towards and away from the sliding surface.

In some embodiments, the permanent magnets are biased away from the sliding surface by a biasing mechanism that releases upon loss of power.

Some embodiments further comprise at least one linear motor unit mounted to one of said vehicle and said sliding surface for affecting sliding motion of the vehicle on the sliding surface.

Some embodiments further comprise linear motor units located beneath the sliding surface for affecting sliding motion of the vehicle on the sliding surface.

In some embodiments, the at least one reaction plate and the at least one permanent magnet are each mounted at at least one side of said respective vehicle and said respective sliding surface.

In some embodiments, the at least one permanent magnet is adapted to decelerate or stop the vehicle on the sliding surface.

In some embodiments, the at least one permanent magnet is adapted to hold the vehicle and the linear motor units are adapted to accelerate the vehicle.

In some embodiments, the permanent magnets are positioned to decelerate or stop the vehicle if the vehicle slides outside of a predetermined sliding area.

In some embodiments, the permanent magnet is positioned at a relative elevation of the sliding surface.

In some embodiments, the ride feature is flume-style, the sliding surface is a bottom surface of a water flume, and said vehicle is adapted to convey said at least one rider along said water flume.

Some embodiments disclosed herein relate to a method of controlling the sliding motion of a vehicle sliding on a sliding surface in an amusement ride, comprising: providing the waterslide sliding surface; placing the vehicle on the sliding surface, the vehicle having a vehicle bottom surface adapted to slide on said sliding surface and to convey at least one rider thereon; providing at least one reaction plate and at least one permanent magnet each mounted to one of said vehicle and said sliding surface; positioning the at least one reaction plate and the at least one permanent magnet to affect motion of the vehicle when the motion of the vehicle brings the reaction plate under the influence of the permanent magnet; and initiating movement of the vehicle on the sliding surface.

Some embodiments further comprise providing at least one linear motor unit mounted to one of said vehicle and said sliding surface for affecting sliding motion of the vehicle on the sliding surface; and operating the linear motor units to affect sliding motion of the vehicle on the sliding surface.

Some embodiments further comprise positioning the permanent magnets to decelerate or stop the vehicle.

Some embodiments further comprise positioning the permanent magnets to decelerate or stop the vehicle and operating the linear motor units to accelerate the vehicle.

BRIEF DESCRIPTION OF THE DRAWINGS

Embodiments of the invention will now be described with reference to the attached drawings in which.

DETAILED DESCRIPTION OF THE DRAWINGS

Embodiments of the present invention are directed to amusement rides in which participants ride in vehicles which slide on a sliding surface. As the term is used in the amusement ride industry, "sliding" refers to the action of moving substantially smoothly along a weight-bearing sliding surface while remaining substantially in contact with it. This is in contrast to "rolling" which refers to the action of moving along a weight bearing surface by the relative rotation of wheels, rollers, bearings, etc. When the vehicle is sliding, it is normally free to move across, toward and away from the sliding surface.

In a waterslide context, sliding is typically facilitated by the use of water as a lubricant between the vehicle and the sliding surface. In such cases, on occasion, such as when the layer of water has sufficient depth and the vehicle has sufficient speed or lubrication, direct contact between the vehicle and the flume may be lost very briefly and temporarily with the vehicle skimming atop a very thin layer of water. However, such temporary skimming is still considered to fall within the meaning of "sliding" in the waterslide context. Lubricants other than water could also be used. Lubricants may also be eliminated if the sliding surface and the vehicle are sufficiently smooth.

Embodiments will now be described.

Flume-style waterslides typically comprise a channel or "flume" supplied with water and which accommodates a vehicle for sliding therein. The flume typically has hills and valleys as well as turns to increase the excitement of the ride for the participant. While the amusement ride described below is a flume-style waterslide, it is to be understood that in a broad sense, embodiments of the invention relate to amusement rides generally including non-flume water rides and non-water rides.

Figure 1:
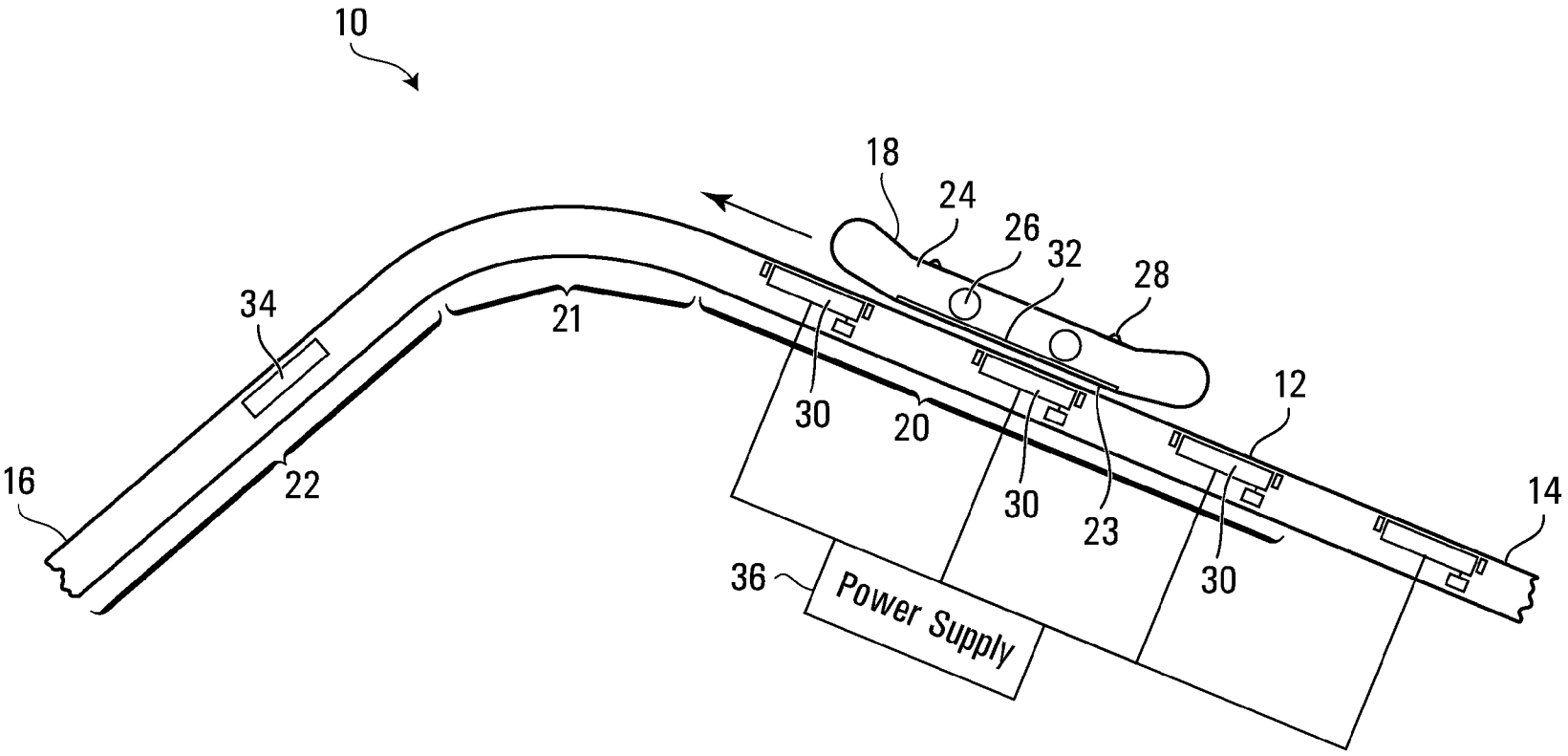
FIG. 1 is a side view of a section of a flume of an embodiment of the present invention with the sides of the flume and the sides of the sliding surface removed to show the vehicle and the components underneath the sliding surface.

FIG. 1 shows a side view of an exemplary flume 10 in accordance with a first embodiment of the invention. The flume 10 has a sliding surface 12. The side of the sliding surface 12 is cut away to show what is beneath the sliding surface 12. The flume 10 has an entry 14, on the right, and an exit 16, on the left. A vehicle 18 would normally move from the entry 14, on the right, to the exit 16, on the left. The flume 10 may have sides (not shown) to help retain and guide the vehicle 18 on the sliding surface 12. The sides of the flume have been omitted for ease of view.

In operation, the illustrated section is connected at its entry 14 and its exit 16 ends to other sections of the flume ride so as to provide a continuous flume from start to finish of the ride. The illustrated section would also normally be supported underneath by appropriate framing (not shown), or by a sloped section of land (not shown).

The flume 10 is generally comprised of the above-mentioned sliding surface 12, as well as two side walls (removed in FIG. 1 to show the vehicle 18). The sliding surface 12 is the surface on which the vehicle 18 slides, while the side walls (not shown) assist in ensuring that the water and the vehicle 18 remain in the flume 10. The sliding surface 12 and side walls may be made of any material providing sufficient toughness and rigidity, and may be smooth so as to permit easy sliding of the vehicle 18 thereon. In this embodiment, the sliding surface 12 and side walls are made of fiberglass, and in particular a combination of neo-isothalic gelcoat, chop strand E-Glass or S-Glass fiber, woven roving and isothalic and orthothalic resins. The sliding surface 12 in this embodiment may be subdivided into an upward section 20, a transition or "hump" section 21 and a downward section 22.

In this embodiment, the vehicle 18 is a raft adapted to carry one or more riders thereon and is provided at its bottom with a vehicle bottom surface 23 adapted to slide along the sliding surface 12 of the flume 10 during normal operation. The vehicle 18 in this embodiment has side tubes 24, thwarts 26 and handles 28.

Means are provided to impart a thrusting force to the vehicle 18 to assist it up the upward section 20 of the flume 10. Such a force is desirable, for example, where the speed of the vehicle 18 arriving at the entry end 14 of the upward section 20 from another part of the flume ride is not sufficient to propel the vehicle 18 up the upward section 20 at a desired speed, on the basis of the vehicle's momentum alone.

In some embodiments, the external force necessary to achieve the desired speed may be provided with water jets or a conveyor as described above. In this embodiment, the external force is provided by a linear motor. Such a linear motor is described in co-owned U.S. Pat. No. 7,918,741 and co-owned U.S. Patent Application Publication Nos. 2007/0207867, 2007/0207866, and 2007/0204759, the disclosures of which are incorporated herein by reference in their entirety.

Conceptually, the linear motor of an exemplary embodiment may be a standard rotary squirrel cage linear induction motor which has been opened out flat with the stator units lying in a spaced linear configuration and the rotor being replaced by a substantially flat reaction plate. The units of the stator, known as linear induction motor units ("LIM units") in this example when laid out flat, each comprise a 3 phase winding around a laminated iron core. When the LIM units are energized by an alternating current (AC) supply, a travelling wave magnetic field is produced. The flat stator of the linear induction motor effects linear movement in the reaction plate.

The reaction component or plate in such LIMB is typically a sheet of any electrically conductive metal, for example aluminum or copper. The conducting sheet may be backed by steel to provide return paths for the stator's magnetic flux. Currents induced in the reaction plate by the LIM units' travelling field create a secondary magnetic field. It is the reaction between these two magnetic fields which imparts the linear thrust to the reaction plate. The magnitude of the thrust imparted to the reaction plate is controlled largely by the voltage and frequency of the electrical supply to the LIM units (as supplied by an inverter, not shown) and the dimensions and materials of the reaction plate. Thrust of the LIM can be reversed if the polarity is changed on the LIM units.

In the present embodiment, LIM units 30 are located beneath the sliding surface 12 of the flume 10 in spaced linear relationship in the direction of travel of the vehicle 18. A reaction plate 32 is mounted in the bottom of the vehicle 18 and is covered by the vehicle bottom surface 23. The LIM in this embodiment is used to move the vehicle 18 up the upward section 20 of the sliding surface 12.

Each LIM unit 30 of this embodiment is rectangular in shape and is substantially flat. In this embodiment, the dimensions of each LIM unit are 500 mm in length, 250 mm in width, and 85 mm in height and provides a thrust of 600N at 480V, 60 Hz AC current and 20% duty cycle. Of course other dimensions, other voltages, other frequencies and other duty cycles may be used to provide a required thrust.

The LIM units 30 are substantially centered between the side walls of the flume 10. An upper surface of the LIM units 30 may alternatively form part of, or the entirety of the sliding surface 12. In either case, the functioning portions of the LIM units 30 are located beneath the sliding surface 12. The LIM units 30 may be electrically connected to a controlled power supply 36.

The reaction plate 32 is substantially flat and oblong in this embodiment. In other embodiments, other shapes of reaction plate 32 may be used, elliptical, round or square for example. In this embodiment the reaction plate 32 is a ⅛" sheet of 1050, 1100, 1200 or 5005 aluminum and a 3⁄32" sheet of A36 galvanized steel affixed above the sheet of aluminum. The reaction plate 32 is 72" in length and 18" in width, with the width of the steel sheet being 2" narrower than the aluminum sheet such that the aluminum sheet extends beyond the width of the steel sheet by 2" on each side. Examples of suitable reaction plates are detailed in a co-owned U.S. Patent Application Publication No. 2007/0204759, previously incorporated herein by reference. The reaction plate may be multipart and may be or may include permanent magnets.

The distance between the reaction plate 32 and the LIM units 30 may be minimized to increase the force imparted on the vehicle 18 by the LIM units 30. In this embodiment, the bottom surface 23 of the vehicle is made of vinyl rubber, and the gap between the reaction plate 32 and the LIM units 30 is about ⅜"-⅝" during operation. Other materials may be used for the vehicle bottom surface 23, such as fiberglass. The vehicle 18 may be loaded with a substantially even distribution of weight or with somewhat greater weight toward the rear of the vehicle 18 so as to try to maintain proximity between the vehicle bottom surface 23 and the sliding surface 12.

The velocity of the vehicle 18 as it exits the upward section 20 of the sliding surface will depend on a number of factors including the voltage and/or frequency of the electrical supply to the LIM units 30; the number, weight and weight distribution of the riders in the vehicle 18; the distance between the reaction plate 32 and the LIM units 30 as the vehicle 18 travels over the upward section 20; and the volume and flow velocity of the water flowing in the flume 10. The variability in velocity of the vehicle 18 may contribute to the excitement of the ride. However, it may be necessary to ensure that the vehicle 18 is not travelling too fast, for example, for safety reasons.

In this embodiment, a permanent magnet 34 is used to provide the desired motion control by providing a braking force. In this embodiment, the permanent magnet 34 is provided at the beginning of the downward section 22 of the sliding surface 12 and mounted parallel to and beneath the sliding surface 12.

Conceptually, the movement of a conductor, the reaction plate 32 in this embodiment, in a magnetic field, that of the permanent magnet 34 in this embodiment, creates eddy currents in the conductor. The eddy currents produced in the reaction plate 32 generate a resultant magnetic field that opposes the magnetic field of the permanent magnet 34. The interaction of the magnetic fields opposes the movement of the reaction plate 32 over the permanent magnet 34 and therefore acts as a braking force. The reaction plate 32 comes under the influence of the permanent magnet 34 and the motion of the vehicle 18 is affected by the permanent magnet 34.

In this embodiment, the reaction plate 32 will come under the influence of the permanent magnet 34 and experience a braking force when it travels over the permanent magnet 34 which will cause the velocity of the vehicle 18 to be reduced. The resultant magnetic field induced in the reaction plate 32 will be proportional to the velocity of the reaction plate 32. The greater the velocity, the greater the resultant magnetic field and the greater the braking force. The result is that if the vehicle 18 is travelling at a high velocity, it will experience a greater braking force than if it is travelling at a lower velocity. The resultant magnetic force will also be dependent on the relative size, shape and composition of the reaction plate 32 and the permanent magnet 34; the distance between the reaction plate 32 and the permanent magnet 34 which may be affected by the number, weight and weight distribution of the riders in the vehicle 18; and the volume, direction and flow velocity of the water flowing in the flume 10.

In operation, the illustrated flume section 10 is provided with water using any of a number of known means, for example, recessed water jets located in the side walls, water flowing from a higher point in the flume, etc. The water provides lubrication between the bottom surface 23 of the vehicle and the sliding surface 12 of the flume 10 so as to facilitate movement of the vehicle 18 up the upward section 20. In this embodiment, the water layer on the sliding surface 12 is 1-3 mm in depth, though it is to be understood that other depths of water may be used.

At the start of the ride, the vehicle 18 may be launched from a launching station (not shown) of the flume, or movement may be otherwise initiated, and proceeds along the flume. The LIM units 30 are powered by the power supply 36. As the vehicle 18 mounts the upward section 20, the magnetic field generated by the LIM units 30 provides a linear thrust to the reaction plate 32 affixed at the bottom of the vehicle 18, causing the vehicle 18 to maintain its speed, or accelerate up the upward section 20. The LIM units 30 may be powered successively, one or two or three at a time to provide thrust to the vehicle 18 as needed. Sensors may be used to detect the velocity and location of the vehicle 18 and energize the LIM units 30 appropriately.

After the vehicle 18 exits the upward section 20, the vehicle 18 will enter the transition or hump section 21. In this section, the vehicle 18 transitions from an upward direction of travel to a downward direction of travel. The vehicle will then move into the downward section 22. The vehicle 18 will travel over the permanent magnet 34. The reaction plate 32 will experience a braking force when it travels over the permanent magnet 34 which will cause the velocity of the vehicle 18 to be reduced. The resultant magnetic field induced in the reaction plate 32 will be proportional to the velocity of the reaction plate 32. The greater the velocity, the greater the resultant magnetic field and the greater the braking force. The result is that if the vehicle 18 is travelling at a high velocity, it will experience a greater braking force than if it is travelling at a lower velocity. The permanent magnet 34 thus has a velocity equalizing effect by reducing the velocity of the vehicle 18 to a safe range, if the vehicle 18 is travelling at too high a velocity, but not overly reducing the velocity of the vehicle 18, if it is travelling at a slower speed.

The vehicle 18 will not stop but will continue to travel along the downward section 22 under gravity.

The permanent magnet 34 may be described as a single sided braking mechanism since the permanent magnet 34 is on one side of the reaction plate 32.

While this embodiment has been described as including both linear motors and a permanent magnet, it will be understood that the linear motors may be omitted and the permanent magnet used to provide a braking force in embodiments which do not incorporate any linear motors.

Figure 2:
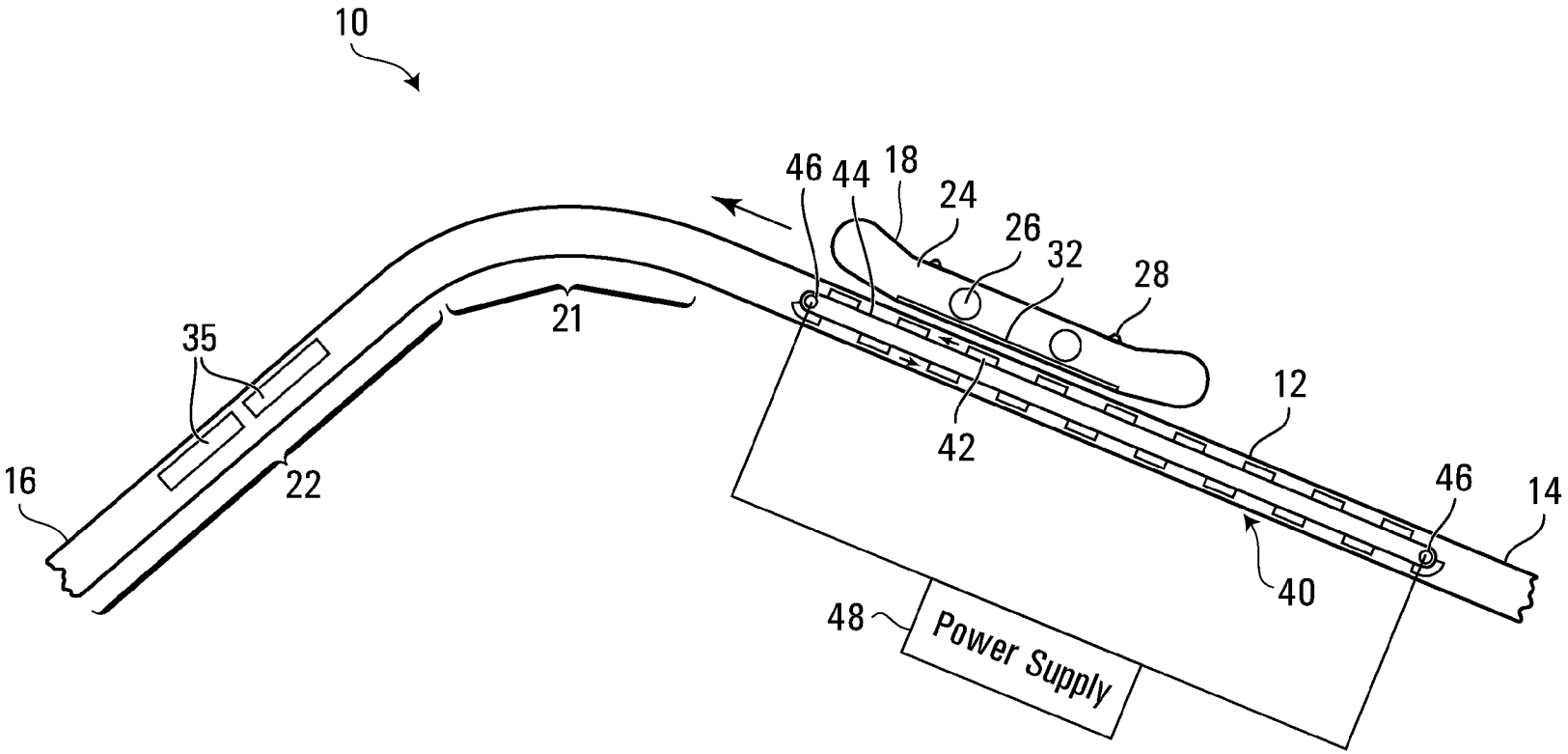
FIG. 2 is a side view of a section of a flume of another embodiment of the present invention with the sides of the flume and the sides of the sliding surface removed to show the vehicle and the components underneath the sliding surface.

FIG. 2 shows another embodiment of the invention in which linear motor units are replaced with permanent magnets. In FIG. 2, the same references characters are used to depict the same features as shown in FIG. 1. FIG. 2 will be described only to the extent that FIG. 2 differs from FIG. 1. In FIG. 2, the LIM units 30 are replaced by a permanent magnet drive assembly 40. The permanent magnet drive assembly 40 includes a plurality of permanent magnets 42 connected to an endless drive belt 44. The drive belt 44 of this embodiment runs over drive pulleys 46. The pulleys 46 are connected to a power supply 48. In this embodiment, the power supply 48 turns the drive pulleys 48 which drives the drive belt 44 in a counter-clockwise direction such that the magnets 42 closest to the sliding surface 12 move upward. The magnets 42 closest to the sliding surface 12 attract the reaction plate 32 in the vehicle 18 and provide a pulling force on the vehicle 18 upward along the upward section 20 of the flume section 10. The magnets 42 traveling downward are sufficiently far away not to appreciably interact with the vehicle 18.

The intensity and the length of duration of the force exerted by the magnets can be selected based on the type of motion control required. It will also be noted that FIG. 2 depicts two magnets 35 in the downward section 22. The two magnets 35 will exert a force for a longer duration than the single magnet 34 of FIG. 1 since they cover a greater length of the downward section 22, and the vehicle 18, if travelling at the same velocity, will be exposed to a magnetic force for a longer duration, and thereby experience a greater braking force, in the embodiment of FIG. 2, than in the embodiment of FIG. 1.

Although the expression "permanent magnets" has been used, it will be appreciated that numerous types of magnets may be used to provide the desired magnetic force. For example, the magnets may be rare earth magnets. The magnets may also be electromagnets. The magnets 34 and 35 may comprise a plurality of magnets forming a magnet assembly, possibly within a housing, rather than a single magnet.

Figure 3A:
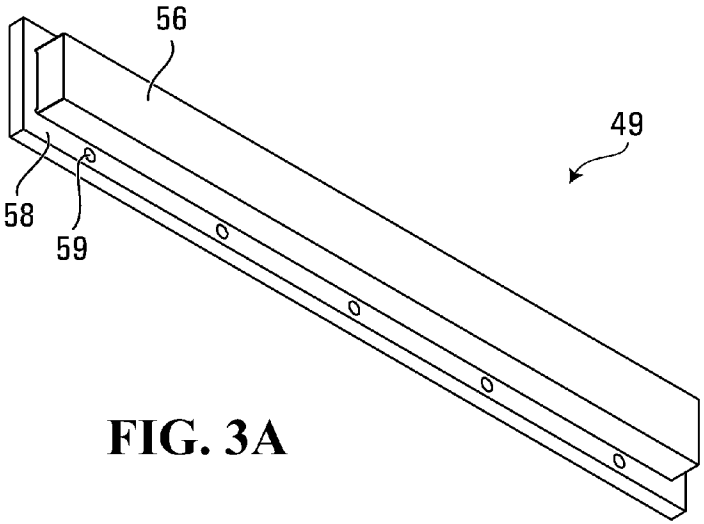
FIGS. 3A to 3C are perspective, top and end views, respectively, of a permanent magnet for the embodiments of FIGS. 1 and 2.
Figure 3B:
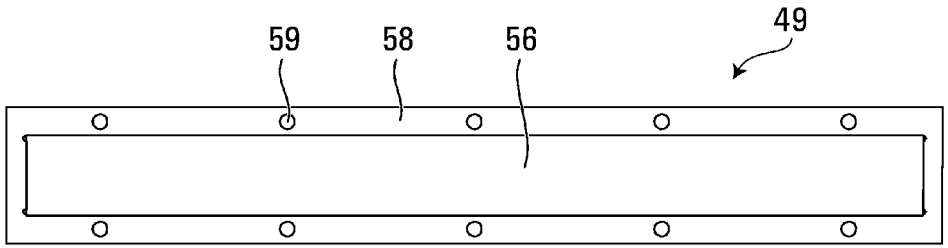
Figure 3C:
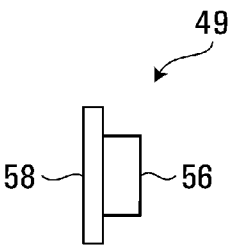

FIGS. 3A, 3B and 3C show a magnet assembly 49 that that may be used as the permanent magnet for an embodiment. The magnet assembly 39 includes a rectangular magnet 56 fixed to a slightly larger rectangular mounting frame 58. The mounting frame 58 may include a series of holes 59 spaced around the perimeter to facilitate mounting of the magnetic assembly 49.

While this embodiment ride has been described as being a waterslide ride, it is to be understood that the present invention can be applied in non-water sliding amusement rides, including so-called dry rides. One example would be a ride in which a vehicle slides on a sliding surface having a low-friction coating such as TEFLON™.

Figure 4A:
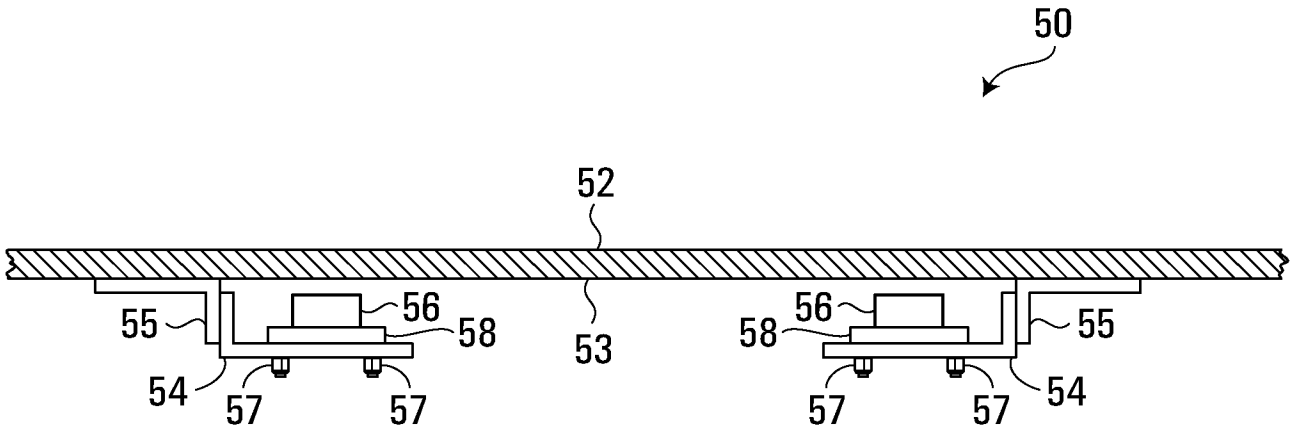
FIGS. 4A and 4B are partial cross-sectional end and partial bottom perspective views, respectively, of a sliding surface and magnets of another embodiment of the present invention.
Figure 4B:
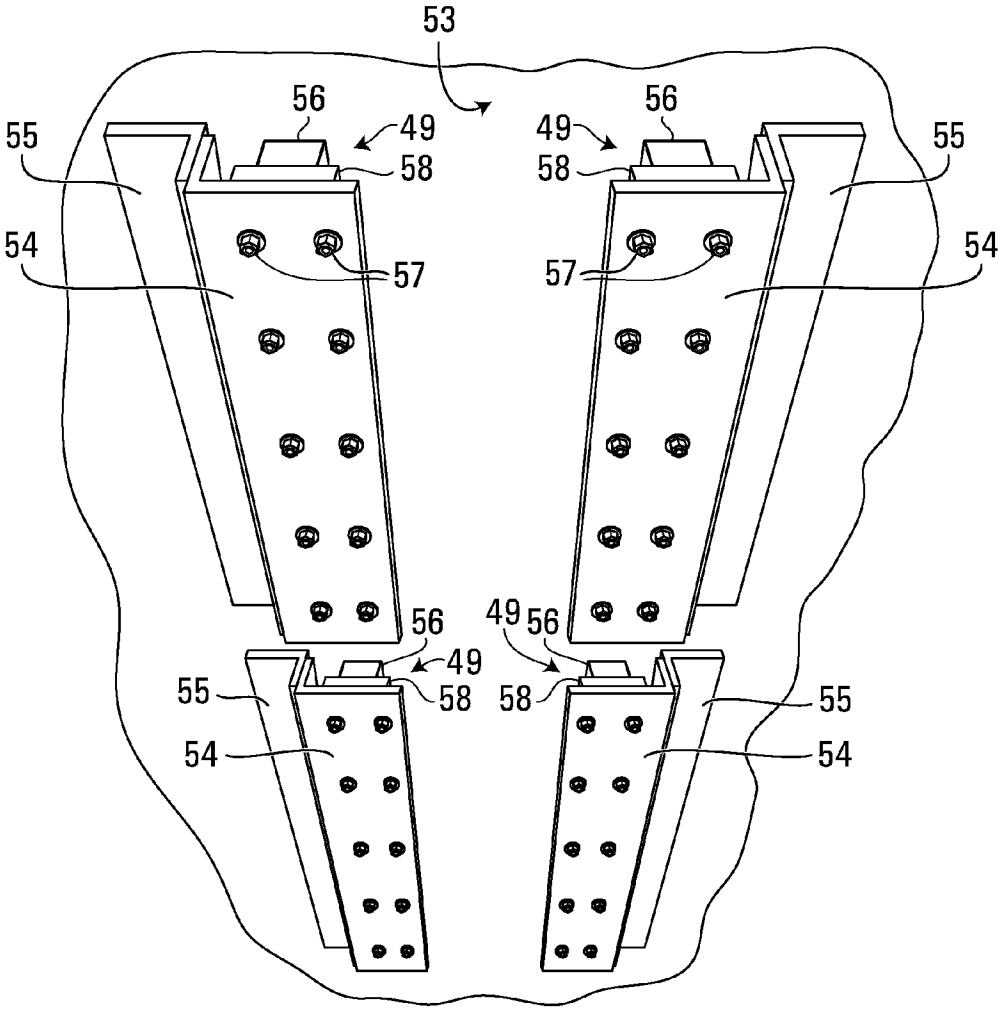

FIGS. 4A and 4B are cross-sectional and bottom perspective views of a portion of a sliding ride 50. The sliding ride 50 includes a sliding surface 52 having a back side 53. In this embodiment, four first angle brackets 55 are fixed at the back side 53 of the sliding surface 52, for example, by an adhesive. The sliding ride 50 of this embodiment includes four magnet assemblies 49 mounted with two sets in parallel. In this embodiment, the magnet assembly 49 of FIGS. 3A to 3C is employed. The mounting frame 58 may be used to attach the magnets 56 to second angle brackets 54 by bolts 57. The second angle brackets 54 are, in turn, fixed to the first angle brackets 55. The spacing between the magnets 56 and the sliding surface 52 will affect the force exerted by the magnets 56 on a vehicle travelling over the sliding surface 52.

The spacing between the magnets 56 and the sliding surface 52 can be controlled by how the second angle brackets 54 are attached to the first angle brackets 55. For example, the second angle brackets 54 may have a series of holes which allow the magnet 56 to be initially mounted via the holes closer to or further from the sliding surface 52. The connection can also be made by an adhesive in FIGS. 4A and 4B. The angle brackets 54 and 55 may be connected through a sliding mount, or other adjustable mounting assembly, perpendicular to the sliding surface 52. The second angle brackets 54 may be fixed to the sliding mount and locked into position with the magnets 56 at an appropriate spacing from the sliding surface 52. This may allow the operator to easily vary the positioning, and therefore the effect of the magnets 56. The sliding mount may be connected to a control assembly with sensors which alter the positioning of the magnets 56 based on some measured characteristic such as vehicle velocity and/or mass or by an external control or preset.

The magnets 56 may also operate as a power outage fail-safe brake. For example, the magnets 56 may be mounted on a structure that has springs that pull the magnets towards the sliding surface but has a powered biasing mechanism to pull the magnets away from the sliding surface. If there is a power outage, the force pulling against the springs is removed and the springs move the magnets closer to the sliding surface 52 to exert a braking force to slow any vehicles on the sliding surface 52.

The magnets 56 may be positioned 1 to 3 inches from the reaction plate in the vehicle. The space between the magnets and the back side 53 of the sliding surface 52 may be open, or may be partially, or completely filled with, for example, ferrite to magnify the effect of the magnets 56.

The positioning of the magnets 56 could be adjusted once (initial adjustment when mounted), could be continuously adjusted (by the vehicle), or actively adjusted (by a constant control system method).

Figure 5:
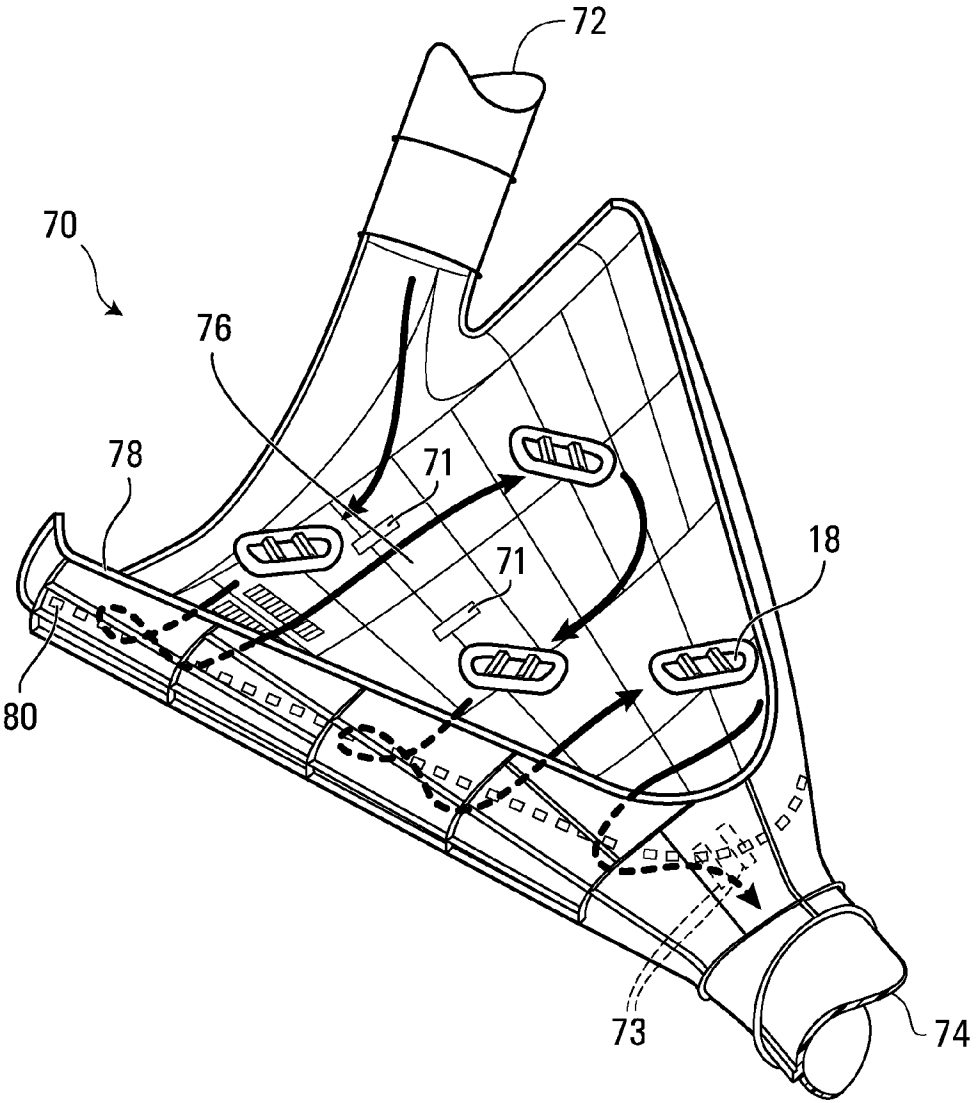
FIG. 5 is a perspective view of a partial funnel of another embodiment of the present invention.

Further, although embodiments have been described in detail in the context of a flume ride, it is to be understood that the present invention may also be applied to other types of sliding amusement rides. For example, FIG. 5 illustrates a partial funnel-style ride feature 70 having an entry 72, an exit 74, and a sliding surface 76 with upper edges 78. In this embodiment, there is no linear motor. Permanent magnets 70, 71 and/or 73 are positioned at or below the sliding surface 76. The permanent magnets 80, 71 and 73 may be used in three different ways.

The permanent magnets 80 are located at a distance from upper edges 78 along both sides to provide a braking force on the vehicle 18, which includes the reaction plate 32, to prevent it from travelling upwards too close to the upper edges 78. The permanent magnets 80 thus can operate as a safety control feature.

The permanent magnets 71 are spaced along the lowest path of the sliding surface 76 to slow the downward movement of the vehicle 18 towards the exit 74 to prolong the ride experience.

The permanent magnets 73 are located adjacent to the exit 74. The permanent magnets 73 may be two elongated permanent magnets positioned in parallel. The permanent magnets 73 may be used to reorient the vehicle 18, as necessary, to ensure that the vehicle 18 approaches the exit 74 in the correct orientation.

In some embodiments, the positioning of the permanent magnet and the reaction plate, or other reaction component may be reversed, so that the permanent magnet is in the vehicle and the reaction component is mounted at or near the sliding surface.

Figure 6:
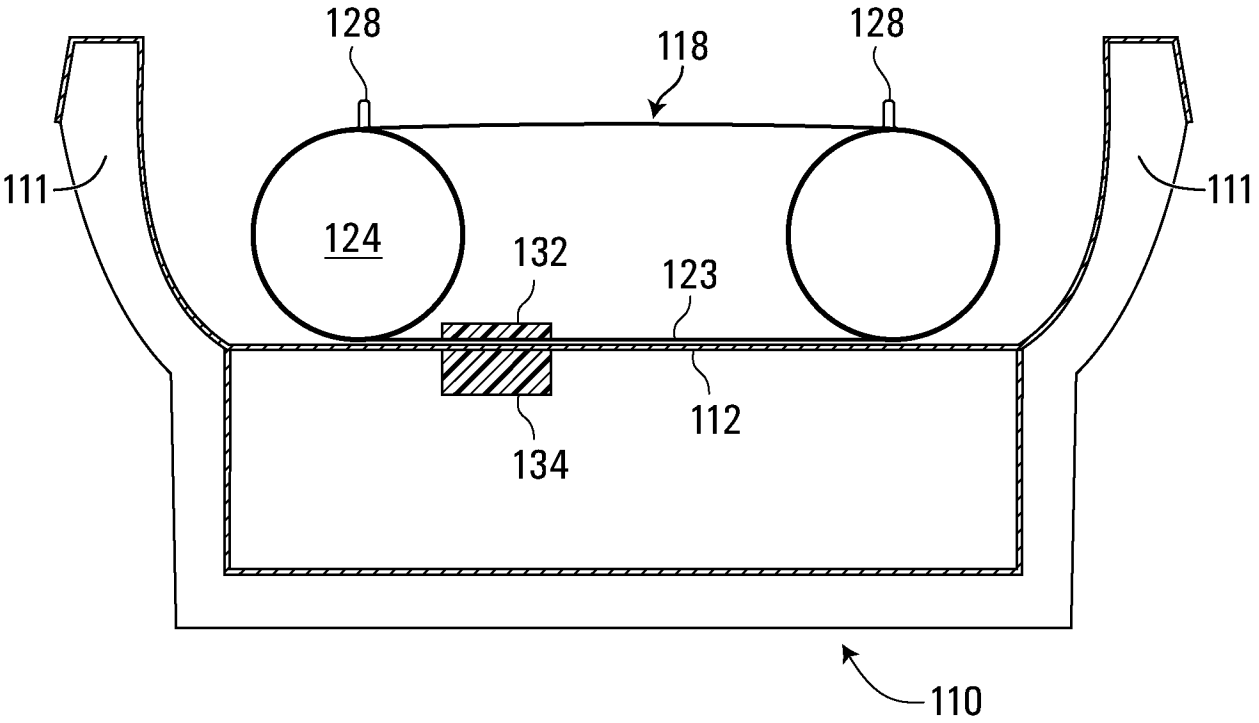
FIG. 6 is a cross-sectional end view of another embodiment of the present invention.

In some embodiments, the permanent magnet and/or reaction component mounted to the raft or to the sliding surface can be mounted off of the centre line of the direction of travel of the vehicle, to induce spin or other effect. For example, FIG. 6 shows a cross-section of a portion of a waterslide ride 110 having a sliding surface 112 and walls 111. A circular raft 118 has a circular outer tube 124 and handles 128. The circular raft 118 also has a bottom surface 123. A reaction component 132 is mounted in the circular raft 118 adjacent the bottom surface 123. A permanent magnet 134 is mounted beneath and adjacent to the sliding surface 112. The reaction component 132 may also comprise part of the bottom surface 123. Similarly, the permanent magnet 134 may comprise part of the sliding surface 112. In use, when the reaction component 132 of the circular raft 118 passes over the permanent magnet 134, the interaction of the permanent magnet 134 with the reaction component 132, may result in the one side of the circular raft 118 being slowed, relative to the other side such that the circular raft 118 will be induced to spin. Other relative placement of the permanent magnet and the reaction component may result in other motions.

In some embodiments the permanent magnet may be used at the start of a ride to slow or hold the vehicle in position for riders to enter and/or exit the vehicle or may be used at an intermediate point on the ride to slow or hold the vehicle for a particular thrill effect, such as just prior to a steep decline.

Further, permanent magnets may be embedded at the end of a ride so as to slow down the vehicle 18 as it approaches the end of the ride, or the launch station. Indeed permanent magnets may be embedded in downhill sections to control the rate of descent of the ride vehicle 18.

Other modifications are possible. For example, instead of the ride vehicle 118 having only one reaction plate 132, it may have multiple reaction plates 132. Further, instead of the permanent magnet 134 being mounted beneath the sliding surface 112 of the flume 110 and the reaction plate 132 being mounted at the bottom of the ride vehicle 118, the permanent magnet 134 may be mounted outside of and parallel to the side walls 111 of the flume 110 and the reaction plate 132 may be mounted to the ride vehicle 118 such that they are parallel to the side walls of the flume when the ride vehicle 118 is in the flume 110.

While the vehicles in the illustrated embodiments has been illustrated as a flat-bottomed raft, it is to be understood that the vehicles in accordance with the present invention can be any vehicle adapted to convey at least one rider in a sliding amusement ride, for example an inner-tube-style vehicle, a multi-rider vehicle, or a platform vehicle.

While the linear motor drive has been described in the illustrated embodiments as comprising linear induction motor units 30 embedded below the sliding surface 16 and the reaction plate 32 mounted at the bottom of the ride vehicle 18, it is to be understood that other suitable configurations are possible. For example, the linear induction motor units 30 may be mounted at the bottom of the ride vehicle 18 and powered by batteries and controlled remotely, with multiple reaction plates 32 mounted beneath the surface of the ride surface 16.

While the features have been described in some cases as having particular dimensions and being made of particular materials, it will be understood by persons skilled in the art that other dimensions and materials may be used without necessarily departing from the scope of the present invention.

Finally, specific details of the particular permanent magnet utilized in the illustrated embodiments of the invention have been provided in some cases. However, persons skilled in the art will understand that other types of permanent magnets having different configurations, specifications, and dimensions can be utilized without necessarily departing from the scope of the present invention.

Numerous modifications and variations of the present invention are possible in light of the above teachings. It is therefore to be understood that within the scope of the appended claims, the invention may be practised otherwise than as specifically described herein.

The invention claimed is:

1. An amusement ride feature comprising:

a sliding surface;

a vehicle having a vehicle bottom surface adapted to slide on said sliding surface and to convey at least one rider thereon; and at least one reaction plate and at least one permanent magnet each mounted to one of said vehicle and said sliding surface;

wherein the at least one reaction plate and the at least one permanent magnet are positioned to affect motion of the vehicle when the motion of the vehicle brings the at least one reaction plate under the influence of the at least one permanent magnet; and wherein the at least one reaction plate or the at least one permanent magnet mounted to the sliding surface is mounted to move relative to the sliding surface.

2. The amusement ride feature of claim 1 wherein the mounting comprises an endless driven member.

3. The amusement ride feature of claim 1 wherein the at least one reaction plate is mounted to the vehicle and the at least one permanent magnet is mounted to the sliding surface.

4. An amusement ride feature comprising:

a sliding surface;

a vehicle having a vehicle bottom surface adapted to slide on said sliding surface and to convey at least one rider thereon; and at least one reaction plate and at least one permanent magnet each mounted to one of said vehicle and said sliding surface;

wherein the at least one reaction plate and the at least one permanent magnet are positioned to affect motion of the vehicle when the motion of the vehicle brings the at least one reaction plate under the influence of the at least one permanent magnet;

wherein the at least one reaction plate is mounted to the vehicle and the at least one permanent magnet is mounted to the sliding surface; and wherein the permanent magnets are mounted on a mounting assembly which is movably towards and away from the sliding surface.

5. The amusement ride feature of claim 4 wherein the at least one reaction plate is mounted near a bottom of said vehicle and substantially parallel thereto, and wherein said at least one reaction plate is covered by the vehicle bottom surface;

and wherein the permanent magnets are located beneath the sliding surface.

6. The amusement ride feature of claim 5 further comprising linear motor units located beneath the sliding surface for affecting sliding motion of the vehicle on the sliding surface.

7. The amusement ride feature of claim 4 further comprising at least one linear motor unit mounted to one of said vehicle and said sliding surface for affecting sliding motion of the vehicle on the sliding surface.

8. The amusement ride feature of claim 4 wherein the at least one reaction plate and the at least one permanent magnet are each mounted at at least one side of said respective vehicle and said respective sliding surface.

9. The amusement ride feature of claim 4 wherein the at least one permanent magnet is adapted to decelerate or stop the vehicle on the sliding surface.

10. The amusement ride feature of claim 4 wherein the at least one permanent magnet is adapted to hold the vehicle and the linear motor units are adapted to accelerate the vehicle.

11. The amusement ride feature of claim 4 wherein the permanent magnets are positioned to decelerate or stop the vehicle if the vehicle slides outside of a predetermined sliding area.

12. The amusement ride feature of claim 4 wherein the permanent magnet is positioned at a relative elevation of the sliding surface.

13. The amusement ride feature of claim 4 wherein the ride feature is flume-style, the sliding surface is a bottom surface of a water flume, and said vehicle is adapted to convey said at least one rider along said water flume.

14. An amusement ride feature comprising:

a sliding surface;

a vehicle having a vehicle bottom surface adapted to slide on said sliding surface and to convey at least one rider thereon; and at least one reaction plate and at least one permanent magnet each mounted to one of said vehicle and said sliding surface;

wherein the at least one reaction plate and the at least one permanent magnet are positioned to affect motion of the vehicle when the motion of the vehicle brings the at least one reaction plate under the influence of the at least one permanent magnet;

wherein the at least one reaction plate is mounted to the vehicle and the at least one permanent magnet is mounted to the sliding surface; and wherein the permanent magnets are biased away from the sliding surface by a biasing mechanism that releases upon loss of power.

* * * * *